US012096873B2

(12) United States Patent
Rupnow

(10) Patent No.: US 12,096,873 B2
(45) Date of Patent: Sep. 24, 2024

(54) CURTAIN CARRIER ASSEMBLY WITH CURTAIN CARRIER

(71) Applicant: InPro Corporation, Muskego, WI (US)

(72) Inventor: Calvin T. Rupnow, Milwaukee, WI (US)

(73) Assignee: InPro Corporation, Muskego, WI (US)

( * ) Notice: Subject to any disclaimer, the term of this patent is extended or adjusted under 35 U.S.C. 154(b) by 70 days.

(21) Appl. No.: 17/957,658

(22) Filed: Sep. 30, 2022

(65) Prior Publication Data

US 2024/0108160 A1 Apr. 4, 2024

(51) Int. Cl.
*A47H 15/04* (2006.01)
*A47H 1/04* (2006.01)
*A47H 13/04* (2006.01)

(52) U.S. Cl.
CPC ..... *A47H 15/04* (2013.01); *A47H 1/04* (2013.01); *A47H 13/04* (2013.01)

(58) Field of Classification Search
CPC ..... A47H 15/02; A47H 15/04; A47H 13/01; A47H 13/02; A47H 13/04; A47H 13/06; A47H 1/04
See application file for complete search history.

(56) References Cited

U.S. PATENT DOCUMENTS 2,703,429 A * 6/1955 Sarkisian ..... A47H 13/04 16/93 D
3,175,243 A * 3/1965 Weber ..... A47H 15/04 211/94.01
3,616,486 A * 11/1971 Ford et al. ..... A47H 15/04 16/87.2
3,951,196 A * 4/1976 Salzmann ..... A47H 1/04 16/87.4 R
4,282,630 A * 8/1981 Toder ..... A47H 15/04 206/343

(Continued)

OTHER PUBLICATIONS

Inpro drawing showing model CE5041 spool carrier which is dated Jun. 25, 2012, retrieved from https://www.inprocorp.com/globalassets/resource-documents/optitrac-carriers.pdf (Year: 2012).*

(Continued)

*Primary Examiner* — Jeffrey O'Brien
(74) *Attorney, Agent, or Firm* — Reinhart Boerner Van Deuren s.c.

(57) ABSTRACT

Embodiments are provided of a curtain carrier forming a part of a curtain carrier assembly configured to support a curtain. The curtain carrier assembly includes an elongate track with a slot. The slot extends lengthwise along an underside of the track. A curtain carrier is slidably coupled to the track. The curtain carrier includes a spool that is slidable lengthwise along the slot. The curtain carrier also includes a stem that is pivotably coupled to the spool. In specific embodiments, at least a portion of the stem protrudes below the spool. In specific embodiments, the stem defines a hook opening sized to receive a curtain hook at a location spaced apart from the spool. The curtain carrier assembly further includes a curtain hook configured to support a portion of a sliding curtain. The curtain hook is coupled to the stem such that the curtain hook passes through the hook opening.

18 Claims, 15 Drawing Sheets

(56) References Cited

U.S. PATENT DOCUMENTS 4,299,008 A * 11/1981 Burns ..... A47H 1/06 16/95 D
4,357,983 A * 11/1982 Hand ..... A47H 5/032 160/345
4,473,102 A * 9/1984 Ohman ..... A47H 5/032 160/345
5,421,059 A * 6/1995 Leffers, Jr. ..... F21V 33/0012 362/253
8,051,536 B2 * 11/2011 Konecek-Hughes ..... A47H 15/04 16/96 R
8,307,499 B2 * 11/2012 Ruffo ..... A47H 13/00 160/178.1 V
8,869,869 B2 * 10/2014 Graneto, III ..... A47H 13/01 160/340
9,289,086 B2 * 3/2016 Atwell ..... A47H 1/04
10,264,908 B2 * 4/2019 Hatton ..... A47H 15/04
10,952,558 B2 * 3/2021 Choi ..... A47H 1/04
11,191,383 B1 * 12/2021 Hatton ..... A47H 1/04
11,297,966 B2 * 4/2022 Alonso ..... A47H 15/02
11,399,650 B2 * 8/2022 Ko ..... A47H 1/06
2012/0018106 A1 * 1/2012 Robledo ..... A47H 1/04 160/330
2013/0167326 A1 * 7/2013 Rowan ..... A47H 15/02 16/94 D
2015/0113769 A1 * 4/2015 Yu ..... A47H 15/02 16/93 R
2017/0172332 A1 * 6/2017 Legault ..... A47H 1/18
2017/0231413 A1 * 8/2017 Schöpfer ..... A47H 15/00 160/330
2022/0015564 A1 * 1/2022 Olsen ..... A47H 13/04
2022/0015566 A1 * 1/2022 Olsen ..... A47H 15/02
2022/0125232 A1 * 4/2022 Locke ..... A47H 1/19
2023/0130071 A1 * 4/2023 Olsen ..... A47H 1/06 16/107

OTHER PUBLICATIONS

Ball & Chain Cube Cubicle Curtain Carrier, https:/www.inprocorp.com/products/privacy-systems/cubicle-curtain-track-and-accessories/ball-chain-carrier, believed to be commercially available at least as early as 1999, Retrieved on Dec. 28, 2022, 7 pages.

* cited by examiner

CURTAIN CARRIER ASSEMBLY WITH CURTAIN CARRIER

BACKGROUND OF THE INVENTION

The present invention relates generally to the field of curtain structures. The present invention relates specifically to a curtain carrier assembly with a curtain carrier having a pivotable and easily assembled stem.

SUMMARY OF THE INVENTION

One embodiment of the invention relates to a curtain carrier that has a spool. The spool is configured to slidably couple to a curtain track. Further, the spool includes a channel that extends through the spool. A pair of opposing ledges protrude into the channel. The pair of opposing ledges are spaced apart from one another by a ledge clearance distance. The curtain carrier also includes a stem having a ball and a rigid base. The ball is positioned within the channel and is supported by the pair of opposing ledges, such that the ball is allowed to pivot with respect to the pair of opposing ledges. The rigid base is coupled to the ball. The rigid base extends through the channel between the pair of opposing ledges and outwardly from the channel such that at least a portion of the rigid base protrudes from the spool. The rigid base is configured to receive and support a curtain hook.

Another embodiment of the invention relates to a curtain carrier with a spool and a rigid stem. The spool is configured to slidably couple to a curtain track. The spool has an upper wall and a lower wall that is opposite the upper wall. A neck extends between the upper wall and the lower wall. Additionally, a channel extends through the spool, such that the channel extends through the upper wall, the lower wall, and the neck. The rigid stem is coupled to the spool within the channel of the spool and extends outwardly from the spool such that at least a portion of the rigid stem is positioned outside the channel. The rigid stem defines a hook opening at a location outside the channel that is configured to receive a curtain hook.

Yet another embodiment relates to a curtain carrier assembly configured to support a sliding curtain. The curtain carrier assembly includes an elongate track. The elongate track defines a slot that extends lengthwise along an underside of the elongate track. The curtain carrier assembly further includes a curtain carrier. The curtain carrier includes a spool and a rigid stem. The spool is slidably coupled to the elongate track. At least a portion of the spool is positioned within the slot such that the spool is slidable lengthwise along the slot. The rigid stem is pivotably coupled to an interior of the spool. The rigid stem protrudes from the spool such that a portion of the rigid stem extends below the spool. The rigid stem also defines a hook opening configured to receive a curtain hook at a location spaced apart from the spool. A curtain hook is coupled to the rigid stem such that the curtain hook passes through the hook opening. The curtain hook is configured to support a portion of a sliding curtain.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present invention is not limited to the details or methodology set forth in the description or illustrated in the figures. It should also be understood that the terminology is for the purpose of description only and should not be regarded as limiting.

Referring generally to the figures, various embodiments of a curtain carrier assembly including a curtain carrier are shown. The curtain carrier includes a spool and a stem that is pivotable with respect to the spool. The curtain carrier includes a spool and a stem that is constructed of minimal components and is pivotable. Applicant has found that the post stem and spool design reduces the locations in which germs may build up and provides and stronger connection between component parts. This feature provides particular benefit in environments, such as hospital rooms, where regular cleaning and sterilization of the structures within the environment is of particular importance. Additionally, Applicant has found the pivotable connection between the spool and the stem to promote smoother operation of the curtain and reduced wear to the curtain carrier as the curtain is extended or retracted, drawing the individual curtain carriers along a track of the curtain carrier assembly.

Figure 1:
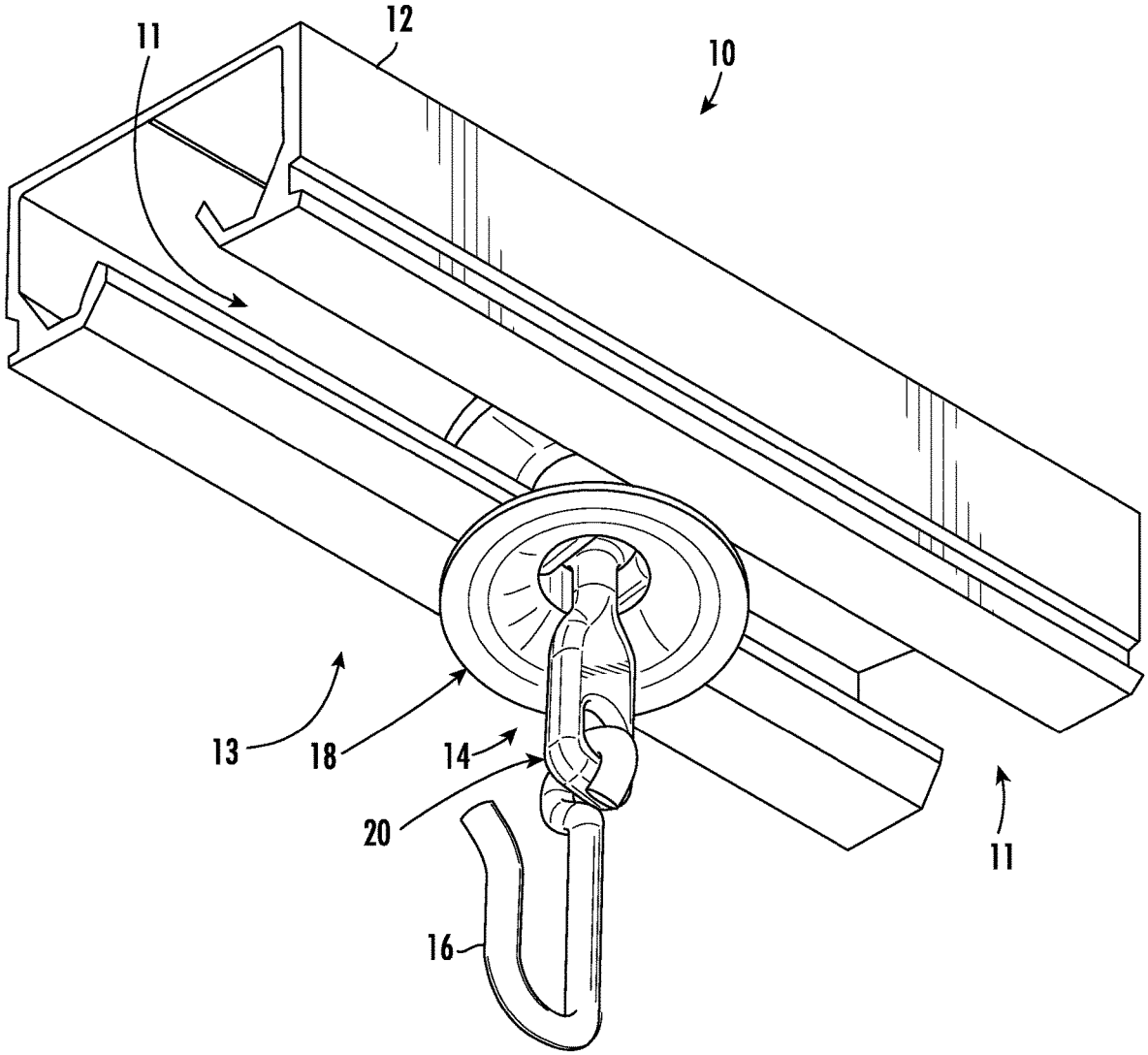
FIG. 1 depicts a perspective view from the bottom of a curtain carrier assembly, according to an exemplary embodiment.
Figure 2:
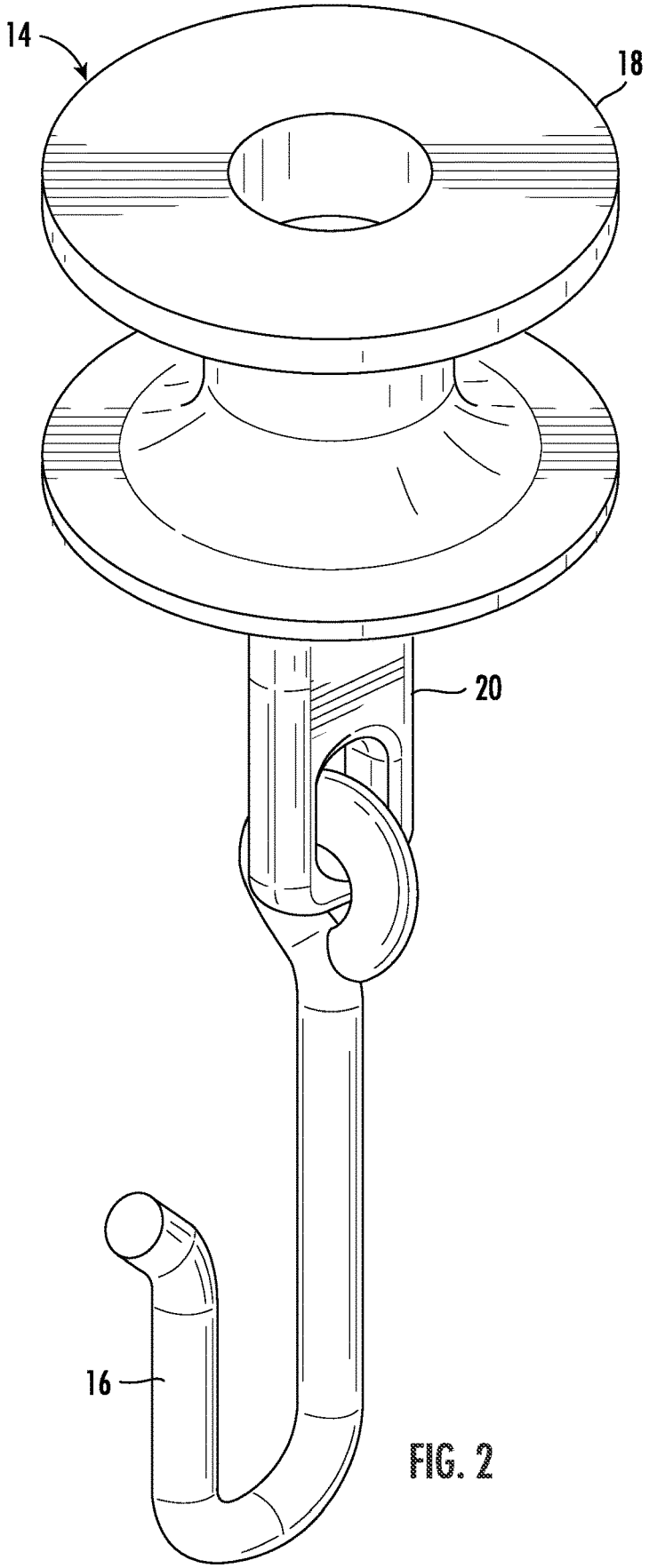
FIG. 2 depicts a top perspective view of the curtain carrier and hook of the curtain carrier assembly shown in FIG. 1, according to an exemplary embodiment.
Figure 3:
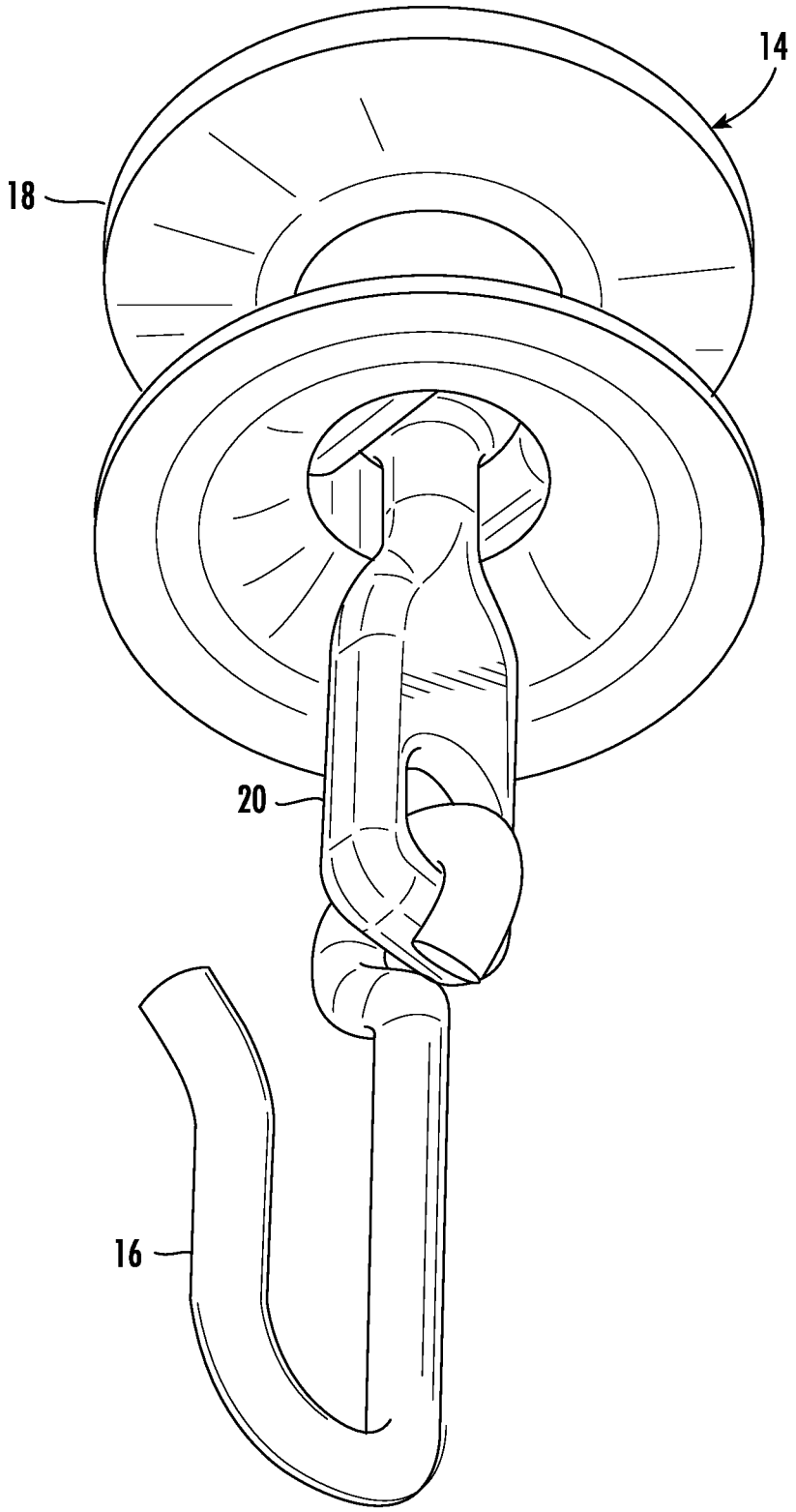
FIG. 3 depicts a bottom perspective view of the curtain carrier and hook of the curtain carrier assembly shown in FIG. 1, according to an exemplary embodiment.

Referring to FIG. 1, a curtain carrier assembly 10 is shown. Curtain carrier assembly 10 includes a track 12. Track 12 is an elongate curtain track that defines a slot 11 extending lengthwise along an underside of track 12. Slot 11 is configured to receive one or more curtain carriers, such as curtain carrier 14. Curtain carrier 14 includes a spool 18 and a stem 20. Spool 18 is slidably coupled to elongate track 12. As shown in FIG. 1, at least a portion of spool 18 is positioned within slot 11 such that spool 18 is slidable lengthwise back and forth along slot 11 of track 12. In specific embodiments, curtain carrier assembly 10 further includes a curtain hook 16 that is configured to support a portion of a sliding curtain. Referring to FIGS. 2-3, additional views of curtain carrier 14 and curtain hook 16 are shown in greater detail. As shown in FIGS. 1-3, curtain hook 16 is coupled to stem 20 at a location spaced apart from spool 18. In specific embodiments, stem 20 is coupled to the interior of spool 18. Further, as shown in FIGS. 1-3, stem 20 extends outwardly from spool 18 such that at least a portion of stem 20 extends below spool 18.

Figure 4:
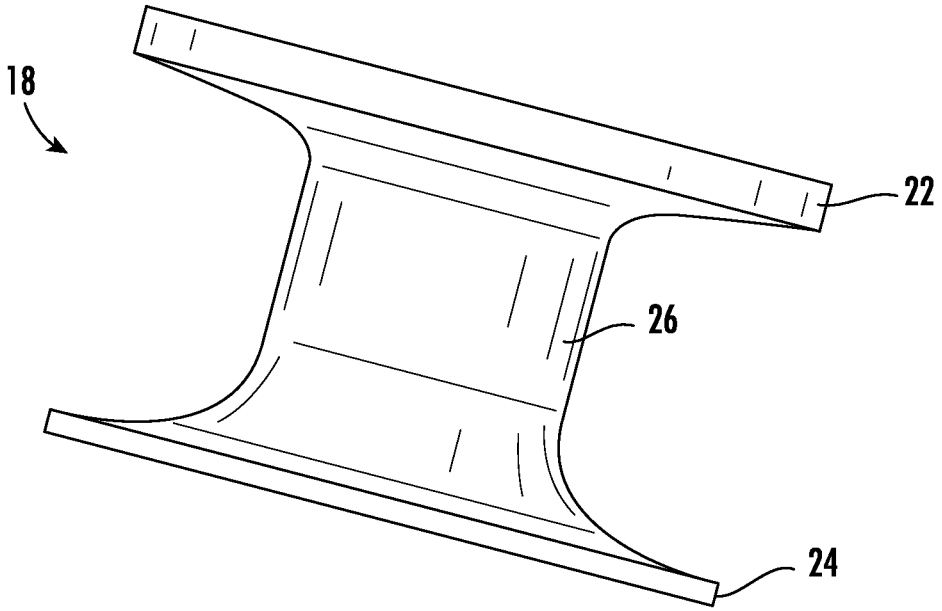
FIG. 4 depicts a perspective view of the spool of the curtain carrier shown in FIG. 2, according to an exemplary embodiment.

FIG. 4 shows a perspective view of spool 18. In specific embodiments, spool 18 includes an upper wall 22, a lower wall 24 opposite upper wall 22, and a neck 26 extending between upper wall 22 and lower wall 24. As shown in FIG. 4, upper wall 22 is parallel to lower wall 24 and spaced apart from lower wall 24 by neck 26. In specific embodiments, neck 26 is narrower than upper wall 22 and narrower than lower wall 24.

Figure 5:
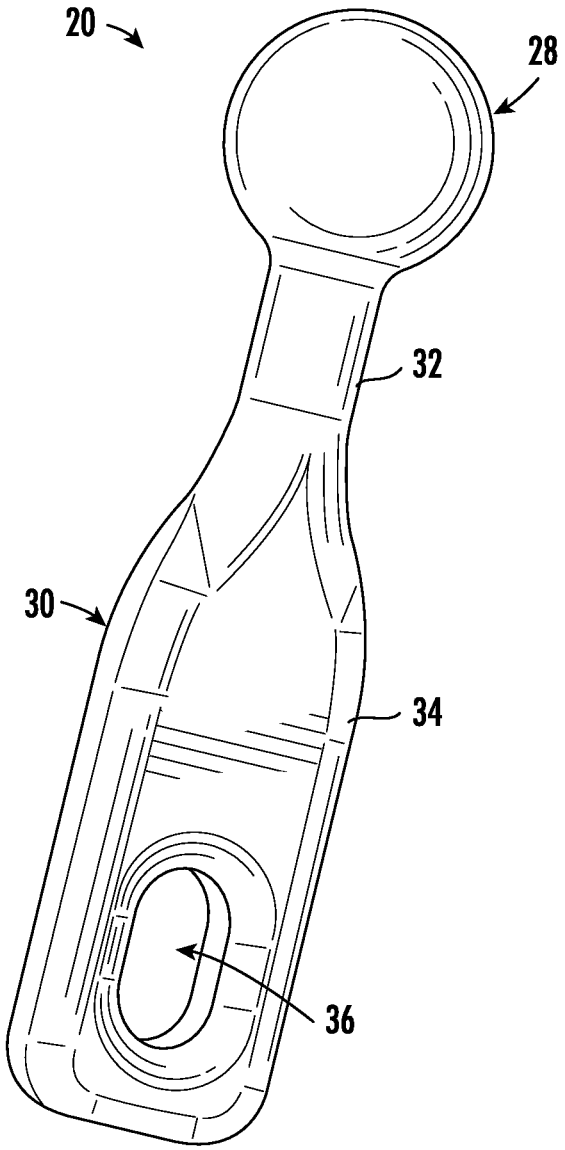
FIG. 5 depicts a perspective view of the stem of the curtain carrier shown in FIG. 2, according to an exemplary embodiment.

FIG. 5 shows a perspective view of stem 20. In specific embodiments, stem 20 includes a ball 28 coupled to a base 30. In specific embodiments, base 30 is a rigid base. As shown in FIG. 5, base 30 is fixedly coupled to ball 28. In specific embodiments, base 30 is integrally formed with ball 28. In certain specific embodiments, stem 20 is a single, integrally formed, rigid piece. When curtain carriers are purchased in bulk, for example by a large entity such as a hospital, the curtain carrier components are frequently shipped together in large packages. Applicant has found the use of a rigid stem, in contrast to the flexible ball and chain stems used in common curtain carriers, to reduce the chances of the stems becoming tangled with one another during transit or during cleaning of multiple parts together. This reduces the time required for curtain carrier assembly and cleaning. The rigid, single-piece stem construction also reduces the risk of small, dangling pieces, being broken off stem 20 during disassembly, reassembly, or cleaning. Applicant has also found this configuration to be economical during the manufacturing process, as a rigid, single-piece construction provides for a stem that is readily created via, for example, molding (e.g. injection molding) of a plastic or casting of a metal such as aluminum.

As shown in FIG. 5, base 30 includes an upper portion 32, extending from ball 28, and a lower portion 34, extending from upper portion 32. In specific embodiments, lower portion 34 extends from upper portion 32, opposite upper portion 32 from ball 28. Specifically, upper portion 32 extends between lower portion 34 and ball 28, separating lower portion 34 from ball 28. In specific embodiments, base 30, defines a hook opening 36 configured to receive a curtain hook, such as curtain hook 16 shown in FIGS. 1-3. As shown in FIG. 5, hook opening 36 is formed in lower portion 34 of base 30.

Figure 6:
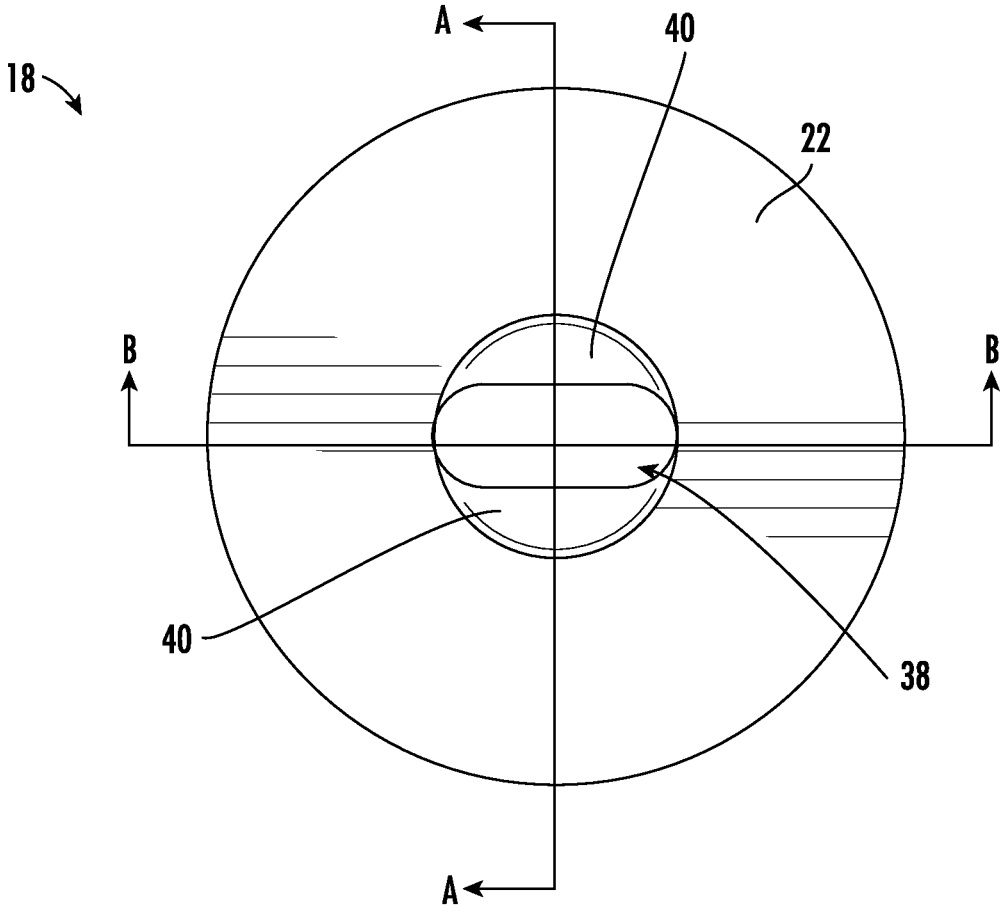
FIG. 6 depicts a top view of the spool shown in FIG. 4, according to an exemplary embodiment.
Figure 7:
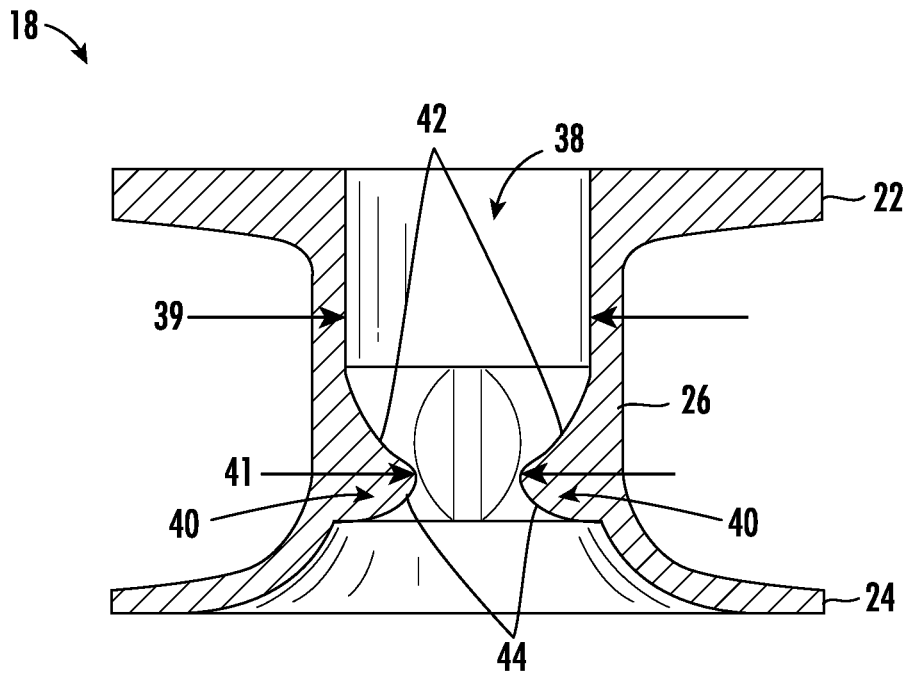
FIG. 7 depicts a cross-sectional view of the spool shown in FIG. 6 taken along section line A-A of FIG. 6, according to an exemplary embodiment.
Figure 8:
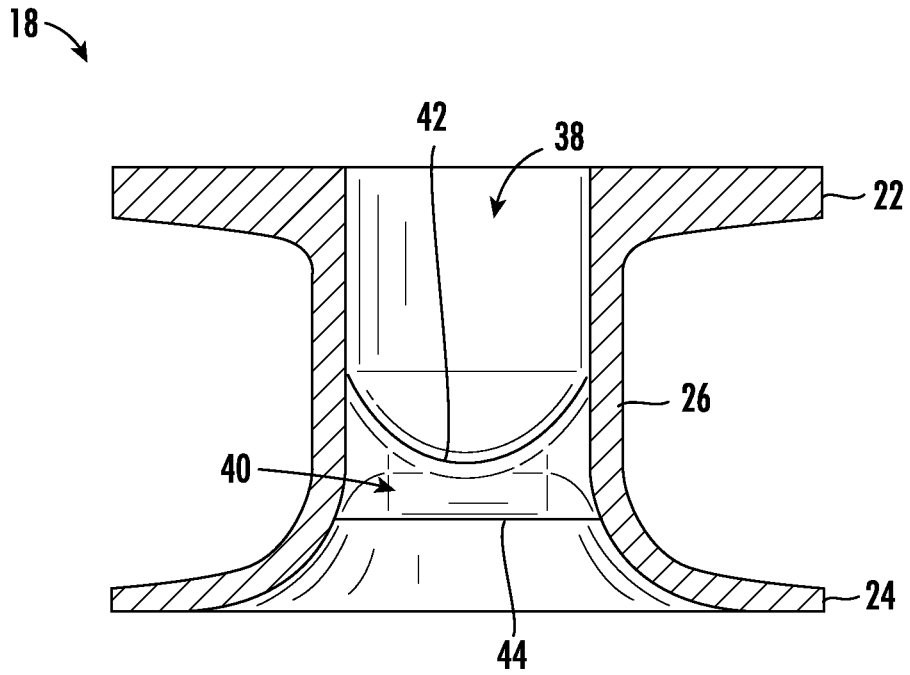
FIG. 8 depicts a cross-sectional view of the spool shown in FIG. 6 taken along section line B-B of FIG. 6, according to an exemplary embodiment.

FIGS. 6-8 show spool 18 in greater detail. In specific embodiments, a channel 38 extends through spool 18, specifically, through upper wall 22, lower wall 24, and neck 26 of spool 18. In specific embodiments, channel 38 is centrally positioned within upper wall 22, lower wall 24, and neck 26 of spool 18. As shown in FIGS. 6-8, one or more ledges 40 protrude into channel 38. In certain specific embodiments, ledges 40 include two opposing ledges 40 that protrude inwardly into channel 38 from neck 26 toward one another. As shown in FIG. 7, the two opposing ledges 40 are spaced apart across channel 38 by a ledge clearance distance 41. In specific embodiments, the ledge clearance distance is 0.135 inches.

In specific embodiments, each ledge 40 includes an upper surface 42 and a lower surface 44. Upper surfaces 42 are configured to receive and support ball 28 of stem 20 such that ball 28 is allowed to pivot freely with respect to ledges 40. In other words, when curtain carrier 14 is assembled, ball 28 is allowed to pivot in any direction, i.e. is not constrained from pivoting movement in any particular direction, with respect to ledges 40. In specific embodiments, upper surfaces 42 are concave, arcuate surfaces.

Applicant has found this pivotable connection to increase the useful life of each curtain carrier 14 compared to a curtain carrier lacking such a pivotable connection, by decreasing the wear to curtain carrier 14 caused by torsion forces when the connected curtain is drawn open and closed. Specifically, when stem 20 of curtain carrier 14 is rotated by the tug of the curtain, the resulting torsion forces are applied namely to stem 20 alone when stem 20 is allowed to pivot with respect to spool 18. When the connection between the stem and spool is fixed, the resulting torsion forces are additionally transferred to the spool, generating wear or causing the curtain carrier to warp at the connection point of the spool and the stem. As shown in FIG. 7, channel 38 has a diameter 39 above upper surfaces 42 of ledges 40. In specific embodiments, diameter 39 is 0.30 inches. As shown in FIG. 7, the diameter of channel 38 expands as channel 38 extends below lower surfaces 44 of ledges 40, which allows a greater range of motion for base 30 of stem 20 when stem 20 pivots with respect to spool 18 during operation.

Figure 9:
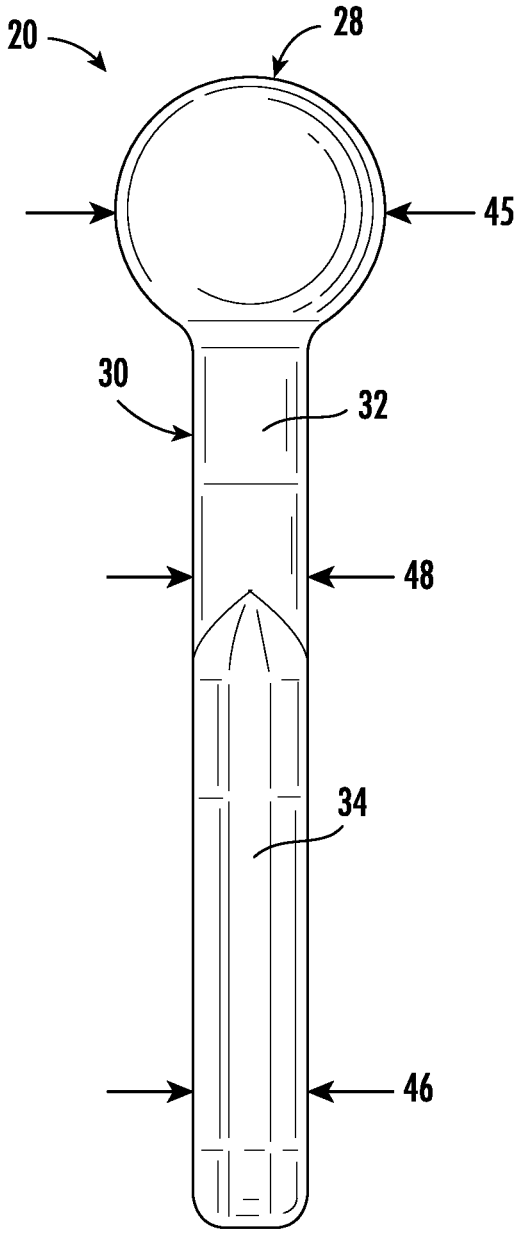
FIG. 9 depicts a front view of the stem shown in FIG. 5, according to an exemplary embodiment.
Figure 10:
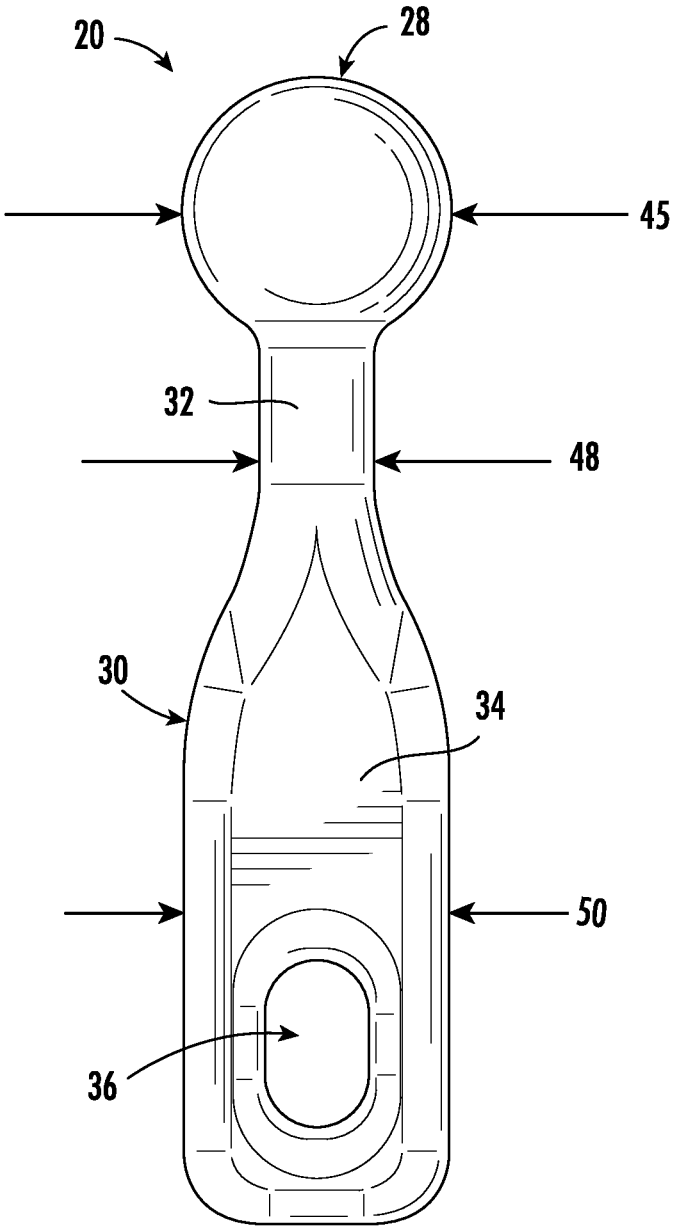
FIG. 10 depicts a front view of the stem shown in FIG. 5, according to an exemplary embodiment.

FIGS. 9-10 show stem 20 in greater detail. As shown in FIGS. 9-10, ball 28 has a diameter 45, upper portion 32 has a diameter 48, and lower portion 34 has a thickness 46 and a width 50. Each of diameter 45 of ball 28, diameter 48 of upper portion 32, thickness 46 of lower portion 34, and width 50 of lower portion 34 is respectively smaller than diameter 39 of channel 38, such that the entire stem 20 can pass through the portion of channel 38 that is above upper the surfaces 42 of ledges 40. In specific embodiments, diameter 45 of ball 28 is larger than ledge clearance distance 41, such that ball 28 is restricted from passing between the two opposing ledges 40. In specific embodiments, when curtain carrier 14 is assembled, ball 28 interfaces with and is supported by the upper surfaces 42 of ledges 40.

Further, in specific embodiments, diameter 48 of upper portion 32 and thickness 46 of lower portion 34 are each respectively smaller than ledge clearance distance 41, and width 50 of lower portion 34 is larger than ledge clearance distance 41. As such base 30 is allowed to pass through channel 38, extending between the pair of opposing ledges 40. When stem 20 is coupled to spool 18, upper portion 32 of base 30 is positioned at least in part between opposing ledges 40. As diameter 48 of upper portion 32 is smaller than ledge clearance distance 41, upper portion 32 is allowed to axially rotate with respect to spool 18. In specific embodiments, the axial rotation of upper portion 32 corresponds to the axial rotation of lower portion 34. As such, base 30 is allowed to axially rotate with respect to spool 18 when curtain carrier 14 is assembled. Further, in specific embodiments, the axial rotation of upper portion 32 additionally corresponds to the axial rotation of ball 28. Accordingly, stem 20 is allowed to axially rotate with respect to spool 18 when curtain carrier 14 is assembled. In certain specific embodiments thickness 46 of lower portion 34 is equal to diameter 48 of upper portion 32. In specific embodiments, diameter 45 of ball 28 is 0.28 inches, diameter 48 of upper portion 32 is 0.125 inches, thickness 46 of lower portion 34 is 0.125 inches, and width 50 of lower portion 34 is 0.28 inches.

Figure 11:
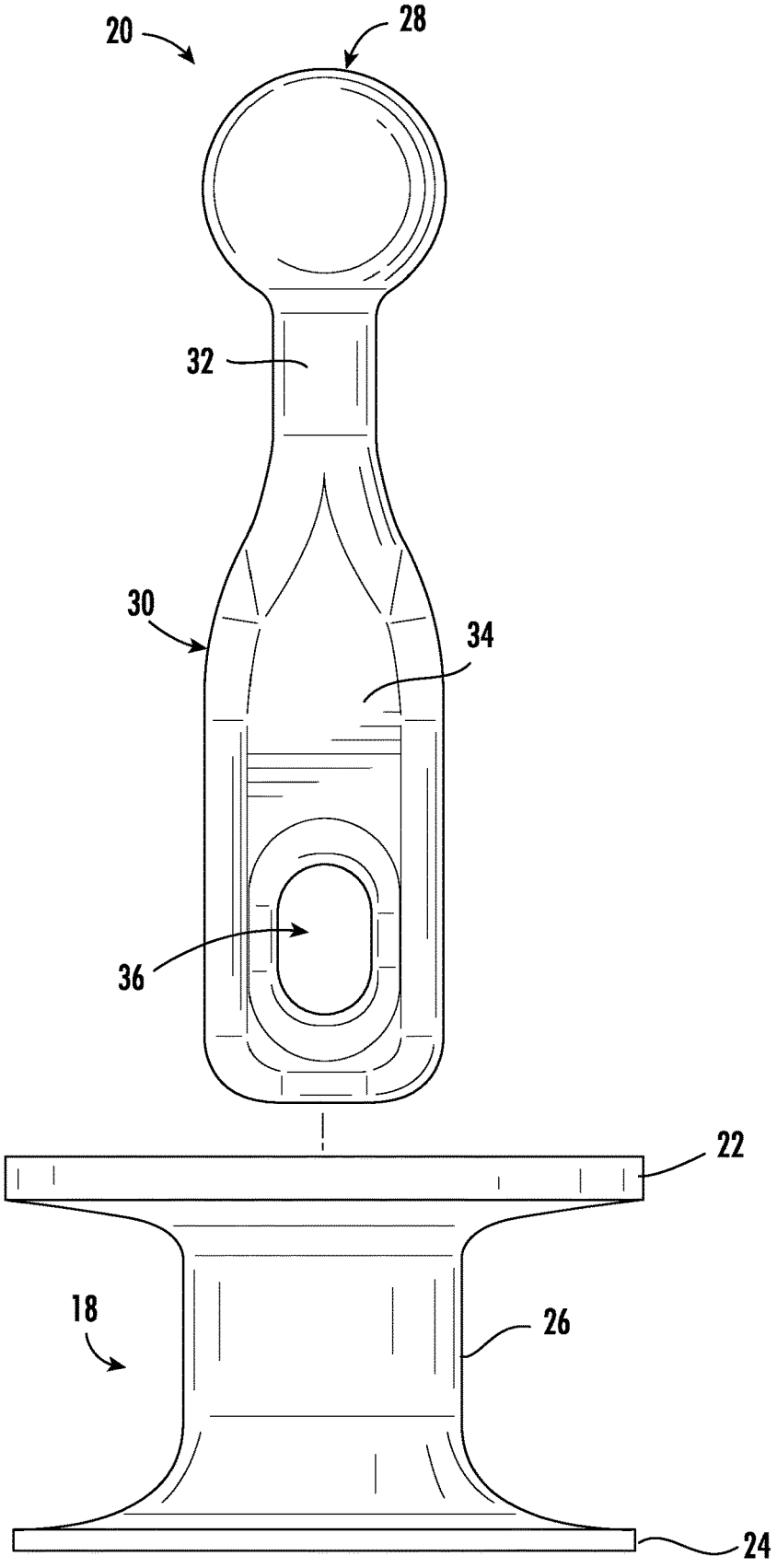
FIG. 11 depicts an exploded view of the curtain carrier shown in FIG. 2 prior to assembly of the curtain carrier, according to an exemplary embodiment.
Figure 12:
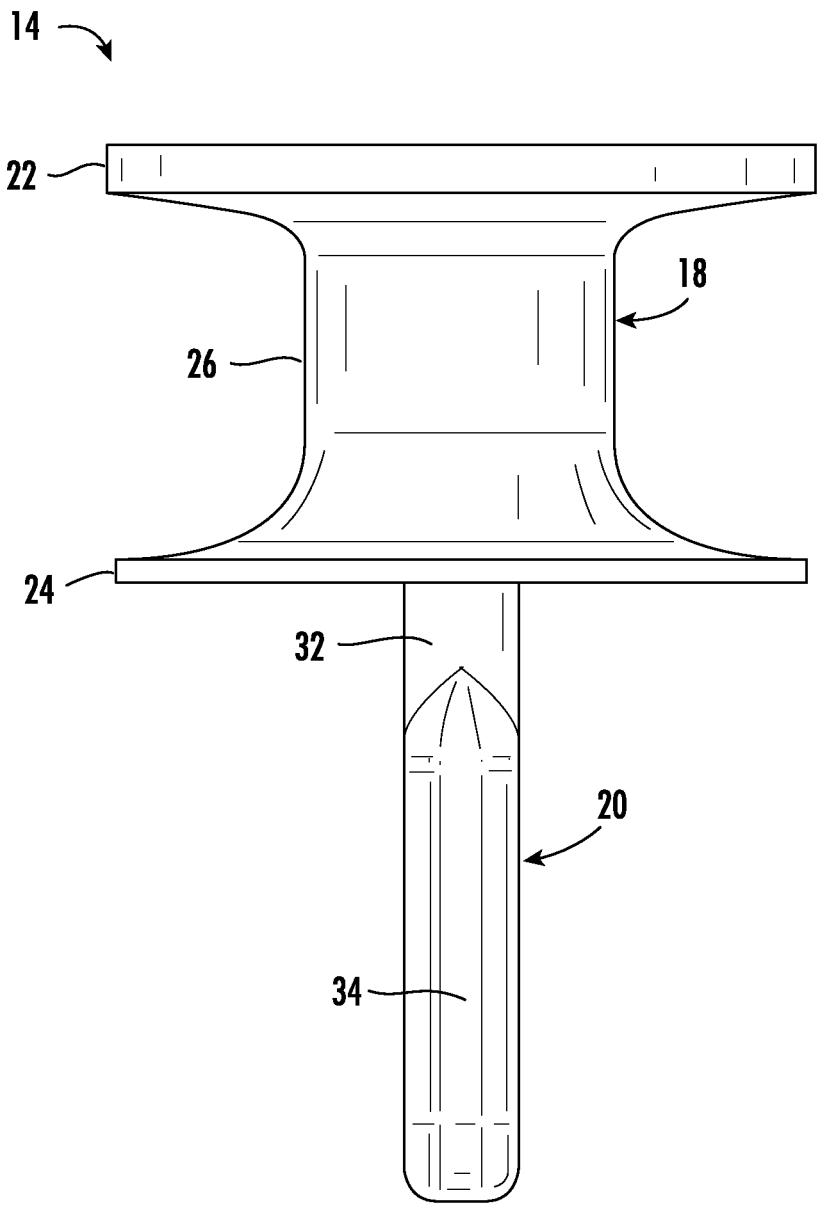
FIG. 12 depicts a front view of the curtain carrier shown in FIG. 2, according to an exemplary embodiment.

Referring to FIG. 11, an exploded or disassembled view is shown of stem 20 removed from spool 18. To assemble curtain carrier 14, stem 20 is lowered from above into spool 18, with lower portion 34 of base 30 first entering spool 18, followed by upper portion 32 of base 30, and then by ball 28. Stem 20 continues to be lowered into spool 18 until ball 28 comes to interface with upper surfaces 42 of ledges 40, pivotably coupling stem 20 to spool 18 within channel 38 of spool 18. An assembled view of curtain carrier 14 is shown in FIG. 12. As shown in FIG. 12, when stem 20 is coupled to spool 18, at least a portion of stem 20 extends beyond spool 18. In specific embodiments, lower portion 34 of base 30 is positioned outside channel 38 and thus outside, specifically below, spool 18. As shown in FIG. 12, stem 20 protrudes or extends outwardly from channel 38 such that at least a portion of stem 20, specifically of base 30, protrudes from spool 18 below spool 18.

Figure 13:
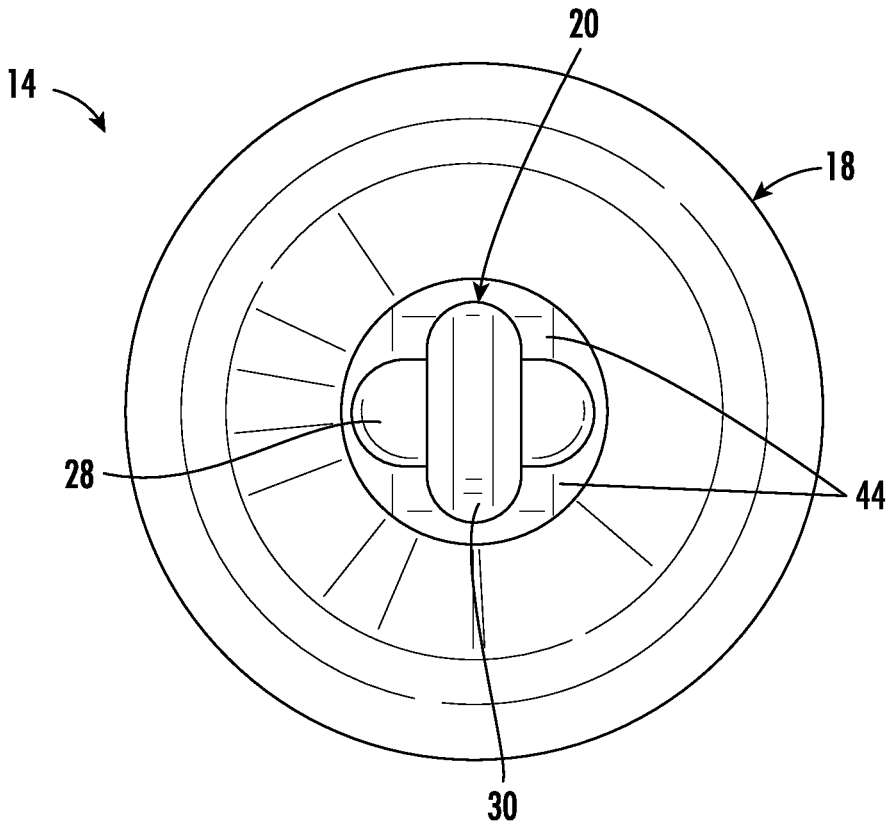
FIG. 13 depicts a bottom view of the curtain carrier shown in FIG. 12, according to an exemplary embodiment.

In certain specific embodiments, stem 20 can be rotated a partial axial rotation to achieve a secure configuration, such as the configuration shown in FIG. 13. The configuration show in FIG. 13 is achieved by a partial axial rotation of a quarter turn or 90 degrees. As the width 50 of the lower portion 34 of base 30 is wider than ledge clearance distance 41, lower surfaces 44 of opposing ledges 40 serve as a barrier to the removal of base 30 from spool 18 in the secure configuration shown in FIG. 13. In specific embodiments, to remove stem 20 from spool 18 in the absence of curtain hook 16, stem 20 is again axially rotated a quarter turn or 90 degrees and removed upwardly through spool 18. This process may be desirable for cleaning purposes.

Figure 14:
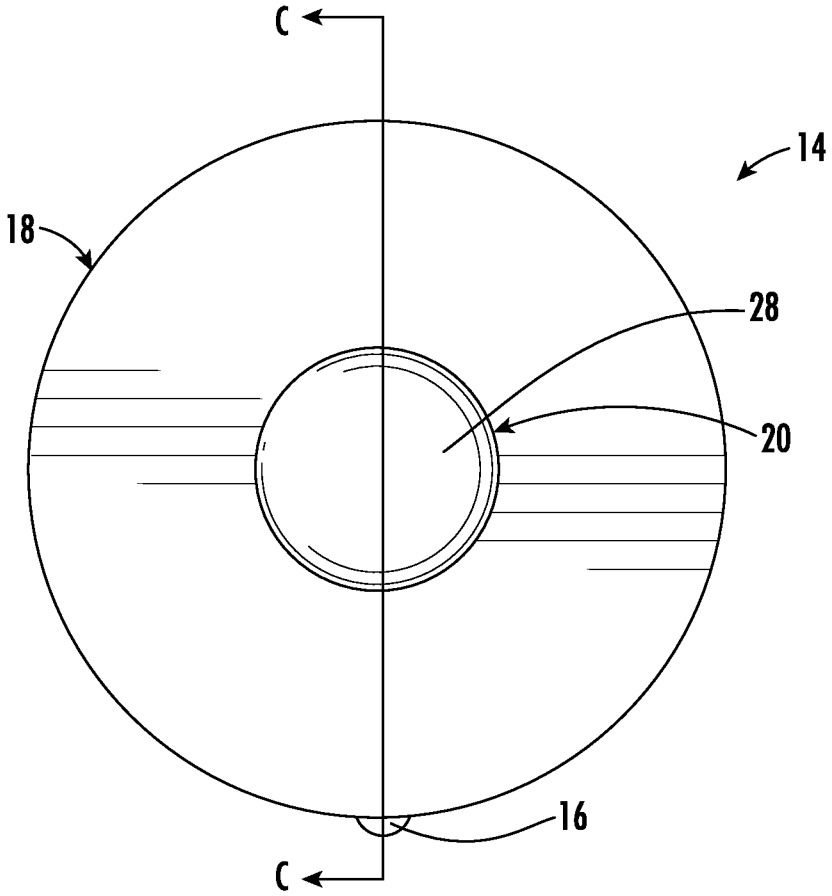
FIG. 14 depicts a top view of the curtain carrier and hook shown in FIG. 2, according to an exemplary embodiment.
Figure 15:
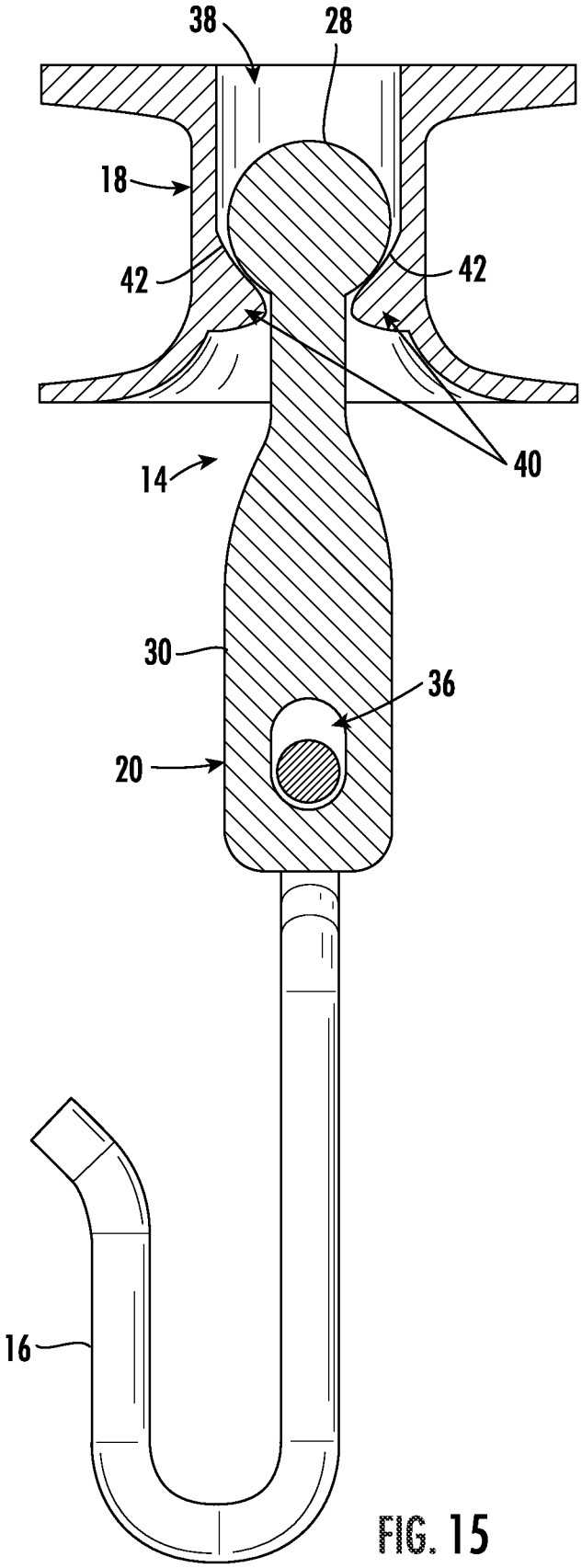
FIG. 15 depicts a cross-sectional view of the curtain carrier and hook shown in FIG. 14, taken along section line C-C of FIG. 14, according to an exemplary embodiment.

FIGS. 14-15 show assembled views of curtain carrier 14 with a curtain hook 16 coupled to stem 20. The coupling of curtain hook 16 to stem 20 serves as an additional preventative barrier to inadvertent decoupling of stem 20 from spool 18 during operation. The additional depth that hook 16 adds to the thickness profile of lower portion 34 of base 30 prevents lower portion 34, and thus base 30, from being drawn back through channel 38 between ledges 40, even if stem 20 is reoriented into its original configuration—a configuration from which base 30 could, in absence of curtain hook 16, be drawn back through channel 38, between ledges 40, and out of spool 18.

As shown in FIG. 15, upon assembly, ball 28 of stem 20 is positioned within and pivotably coupled to spool 18 within channel 38. Specifically, ball 28 is supported by upper surfaces 42 of ledges 40, such that ball 28 is allowed to both axially rotate and pivot freely with respect to opposing ledges 40. Further, as shown in FIG. 15, stem 20, specifically lower portion 34 of base 30, is configured to receive a curtain hook 16 at a location outside of channel 38 and spaced apart from spool 18. In specific embodiments, stem 20 defines a hook opening 36 in lower portion 34 that is configured to receive a curtain hook. As shown in FIG. 15, curtain hook 16 passes through and is supported by hook opening 36.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A curtain carrier comprising:

a spool configured to slidably couple to a curtain track, the spool comprising:

a channel that extends through the spool, and a pair of opposing ledges that protrude into the channel, the pair of opposing ledges spaced apart from one another by a ledge clearance distance; and a stem, comprising;

a ball positioned within the channel and supported by the pair of opposing ledges, such that the ball is allowed to pivot with respect to the pair of opposing ledges, and a rigid base coupled to the ball, the rigid base extending through the channel between the pair of opposing ledges and outwardly from the channel such that at least a portion of the rigid base protrudes from the spool, the rigid base configured to receive and support a curtain hook;

wherein the rigid base comprises an upper portion extending from the ball and a lower portion extending from the upper portion opposite the upper portion from the ball, wherein the thickness of the lower portion of the rigid base is smaller than the ledge clearance distance, and wherein the lower portion has a width that is larger than the ledge clearance distance.

2. The curtain carrier of claim 1, wherein the rigid base is fixedly coupled to the ball.

3. The curtain carrier of claim 2, wherein the rigid base is integrally formed with the ball.

4. The curtain carrier of claim 1, wherein the upper portion is integrally formed with the lower portion.

5. The curtain carrier of claim 1, wherein the pair of opposing ledges each include an upper surface and a lower surface opposite the upper surface, wherein the ball is supported by the respective upper surfaces, and wherein each upper surface is a concave, arcuate surface.

6. A curtain carrier, comprising:

a spool configured to slidably couple to a curtain track, the spool comprising:

an upper wall;

a lower wall opposite the upper wall;

a neck extending between the upper wall and the lower wall;

a channel extending through the spool, such that the channel extends through the upper wall, the lower wall, and the neck;

a first ledge; and a second ledge opposite the first ledge, the first ledge and the second ledge each extending inwardly into the channel from the neck toward one another, the first ledge spaced apart from the second ledge by a ledge clearance distance; and a rigid stem coupled to the spool within the channel of the spool and extending outwardly from the spool such that at least a portion of the rigid stem is positioned outside the channel, the rigid stem defining a hook opening at a location outside the channel that is configured to receive a curtain hook.

7. The curtain carrier of claim 6, wherein the rigid stem is rotatable from a first configuration to a second configuration by a partial axial rotation of the rigid stem, such that in the first configuration a lower portion of the rigid stem is allowed to pass between the first ledge and the second ledge to release the rigid stem from the spool, and in the second configuration the lower portion is barred from passing between the first ledge and the second ledge.

8. The curtain carrier of claim 6, wherein the rigid stem is pivotably coupled to the spool.

9. The curtain carrier of claim 6, wherein the rigid stem is rotatably coupled to the spool, such that the rigid stem is allowed to axially rotate with respect to the spool.

10. The curtain carrier of claim 6, wherein the rigid stem extends between the first ledge and the second ledge.

11. The curtain carrier of claim 10, wherein the rigid stem further comprises a ball that is pivotably coupled to the first ledge and the second ledge, and a base that is fixedly coupled to the ball, the base extending between the first ledge and the second ledge.

12. The curtain carrier of claim 11, wherein the base extends beyond the channel and defines a hook opening at a location outside the channel, the hook opening configured to receive a curtain hook.

13. The curtain carrier of claim 6, wherein the upper wall is oriented parallel to the lower wall, wherein the neck is narrower than the upper wall and narrower than the lower wall, and wherein the channel is centrally positioned within the upper wall, the lower wall, and the neck.

14. A curtain carrier assembly configured to support a sliding curtain, the curtain carrier assembly comprising:

an elongate track defining a slot that extends lengthwise along an underside of the elongate track;

a curtain carrier comprising:

a spool slidably coupled to the elongate track, at least a portion of the spool positioned within the slot such that the spool is slidable lengthwise along the slot, a rigid stem pivotably coupled to an interior of the spool, the rigid stem protruding from the spool such that a portion of the rigid stem extends below the spool, and the rigid stem defining a hook opening configured to receive a curtain hook at a location spaced apart from the spool; and a curtain hook coupled to the rigid stem such that the curtain hook passes through the hook opening, the curtain hook configured to support a portion of a sliding curtain;

wherein the rigid stem further comprises a ball that pivotably coupled to an interior of the spool, such that the rigid stem is allowed to both pivot and axially rotate with respect to the spool, and a base integrally formed with the ball, the base extending below the spool and defining the hook opening of the rigid stem;

wherein the spool defines a channel oriented perpendicularly to the slot, wherein the spool further comprises a pair of opposing ledges that protrude into the channel, the pair of opposing ledges spaced apart from one another by a ledge clearance distance, and wherein the ball of the rigid stem is pivotably coupled to the pair of opposing ledges;

wherein the rigid stem is rotatable from a first configuration to a second configuration by a partial axial rotation of the rigid stem, such that in the first configuration a lower portion of the rigid stem is allowed to pass between the pair of opposing ledges to release the rigid stem from the spool, and in the second configuration the lower portion is barred from passing between the pair of opposing ledges.

15. A curtain carrier comprising:

a spool configured to slidably couple to a curtain track, the spool comprising:

a channel that extends through the spool, and a pair of opposing ledges that protrude into the channel, the pair of opposing ledges spaced apart from one another by a ledge clearance distance; and a stem, comprising:

a ball positioned within the channel and supported by the pair of opposing ledges such that the ball is allowed to pivot with respect to the pair of opposing ledges, wherein the ball has a ball diameter; and a rigid base coupled to the ball, the rigid base extending through the channel between the pair of opposing ledges and outwardly from the channel such that at least a portion of the rigid base protrudes from the spool, the rigid base configured to receive and support a curtain hook, the rigid base comprising:

an upper portion extending from the ball, the upper portion having an upper portion diameter that is narrower than the ball diameter; and a lower portion extending from the upper portion opposite the upper portion from the ball, the lower portion having a thickness that is narrower than the ball diameter;

wherein the pair of opposing ledges are spaced apart across the channel by the ledge clearance distance;

wherein the ball diameter is larger than the ledge clearance distance;

wherein the thickness of the lower portion of the rigid base is smaller than the ledge clearance distance; and wherein the lower portion has a width that is larger than the ledge clearance distance.

16. A curtain carrier, comprising:

a spool configured to slidably couple to a curtain track, the spool comprising:

an upper wall;

a lower wall opposite the upper wall;

a neck extending between the upper wall and the lower wall;

a channel extending through the spool, such that the channel extends through the upper wall, the lower wall, and the neck;

a first ledge; and a second ledge opposite the first ledge;

wherein the first ledge and the second ledge each extend inwardly into the channel from the neck toward one another, the first ledge spaced apart from the second ledge by a ledge clearance distance; and a rigid stem coupled to the spool within the channel of the spool and extending outwardly from the spool such that at least a portion of the rigid stem is positioned outside the channel, the rigid stem defining a hook opening at a location outside the channel that is configured to receive a curtain hook, the rigid stem extending between the first ledge and the second ledge, the rigid stem comprising:

a ball that is pivotably coupled to the first ledge and the second ledge; and a base that is fixedly coupled to the ball, the base extending between the first ledge and the second ledge, the base comprising an upper portion and a lower portion, the upper portion extending between the ball and the lower portion, wherein the lower portion is positioned opposite the first ledge and the second ledge from the ball; and wherein the rigid stem is rotatable from a first configuration to a second configuration by a partial axial rotation of the rigid stem such that in the first configuration the lower portion is allowed to pass between the first ledge and the second ledge to release the rigid stem from the spool, and in the second configuration the lower portion is barred from passing between the first ledge and the second ledge.

17. The curtain carrier of claim 16, wherein the rigid stem is axially rotated 90 degrees between the first configuration and the second configuration.

18. The curtain carrier of claim 16, wherein the lower portion has a thickness that is less than the ledge clearance distance and a width that is greater than the ledge clearance distance.

* * * * *